US007320328B2

(12) United States Patent
Walker

(10) Patent No.: US 7,320,328 B2
(45) Date of Patent: Jan. 22, 2008

(54) PULSED PRESSURE CLEANING APPARATUS AND PROCESS

(76) Inventor: James Byron Walker, 2111 Aurelia, West Bloomfield, MI (US) 48324

( * ) Notice: Subject to any disclaimer, the term of this patent is extended or adjusted under 35 U.S.C. 154(b) by 526 days.

(21) Appl. No.: 10/804,473

(22) Filed: Mar. 19, 2004

(65) Prior Publication Data

US 2004/0261821 A1 Dec. 30, 2004

Related U.S. Application Data

(60) Provisional application No. 60/455,618, filed on Mar. 19, 2003.

(51) Int. Cl.
*B08B 5/02* (2006.01)

(52) U.S. Cl. ..... 134/12.18; 134/26; 134/34; 15/304; 15/345

(58) Field of Classification Search ..... 134/12.12, 134/12.18, 26, 34; 15/345, 304
See application file for complete search history.

(56) References Cited

U.S. PATENT DOCUMENTS 2,650,179 A * 8/1953 Anderson ..... 134/22.12
2,693,944 A * 11/1954 Fowle ..... 366/116
2,968,584 A * 1/1961 Dickey ..... 134/1
3,464,858 A * 9/1969 Hamrick ..... 134/21
3,601,135 A * 8/1971 Marlow et al. ..... 134/102.3
3,998,656 A * 12/1976 Grotto ..... 134/33
4,703,767 A * 11/1987 Spitler et al. ..... 134/102.1
4,933,017 A * 6/1990 Brzoska ..... 134/21
4,933,018 A * 6/1990 Prange ..... 134/22.12
5,007,444 A * 4/1991 Sundholm ..... 134/102.1
5,026,432 A * 6/1991 Johnson ..... 134/21
5,062,502 A * 11/1991 Amano ..... 187/382
5,105,505 A * 4/1992 Reed, Jr. ..... 15/344
5,235,718 A * 8/1993 Grimsley et al. ..... 15/104.095
5,243,733 A * 9/1993 Steiner et al. ..... 15/330
5,322,571 A * 6/1994 Plummer et al. ..... 134/22.12
5,664,284 A * 9/1997 Brzoska ..... 15/330
2005/0150831 A1* 7/2005 Tabani et al. ..... 210/636

* cited by examiner

*Primary Examiner*—Frankie L. Stinson
(74) *Attorney, Agent, or Firm*—John R. Benefiel

(57) ABSTRACT

An apparatus and process are described delivering alternating pulses of fluid and air within either a fully sealed or partially sealed tooling enclave in the direct presence of a constant or variable vacuum source for the purpose of removing loose as well as attached contamination from the part and it's associated internal passageways, as well as internal and external surface areas. The agitation of the debris is created by the displacement of the air or other gases, held under compression by the fluids when released to the vacuum source surrounding, affixed, or presented to the part/area to be cleaned. The fluid/air medium is generated in an alternating method by the use of a rotating pulse generator. The generator receives a constant or alternately a variable rate flow of fluid to be used in the application as well as a constant or alternately variable rate flow of compressed air. Specific port locations within the rotating device transfer to a conduit a specific quantity of fluid followed immediately by a specific charge of the compressed air with each rotation and alignment of the respective ports. Variable speeds of rotation likewise generate either greater or lesser quantities of materials at the selected material pressures. These materials are then transferred within the fluid/air delivery tube which if observed, would be seen as a charge of fluid followed by a charge of air followed by a charge of fluid and so on. The immediate removal of these contaminants is by means of the supplied vacuum source. This minimizes the possibility for the displacement and reintroduction of the contamination to the part being cleaned. After removal, they are filtered for collection along with the fluids which are also removed, as well as separated and filtered for reuse within the process.

6 Claims, 14 Drawing Sheets

PULSED PRESSURE CLEANING APPARATUS AND PROCESS

CROSS REFERENCE TO RELATED APPLICATIONS

This invention claims the benefit of U.S. provisional Ser. No. 60/455,618, filed Mar. 19, 2003.

BACKGROUND OF THE INVENTION

A variety of techniques have been attempted to improve the delivery of fluids for the purpose of washing, cleaning or removing contaminants from the surfaces of component parts. The prior techniques require a part such as an engine, cylinder head, transmission valve body, ABS brake proportioning valve, etc., to be transferred from the rough machining operation into a washing chamber where fixed high pressure jets apply washing solutions to various areas of the part. The configuration of the directed fluid streams can only impact areas of the machined surfaces and gross external surfaces and internal surface areas. Internal passageways such as oil galleys, water jackets, deep tapped bolt holes present a unique problem in that any fluid directed at these cavities will eventually be stagnated by the placement of the fluid in an area where it has no outlet. Following the wash cycle, there is usually a rinse cycle which repeats this process and then a drying cycle. Each of these cycles requires considerable equipment which could include machines performing a "shake-out" and alternately repositioning of the part to remove loosened debris. Within the part, there are many areas which contain crevices and drilled holes that tend to capture small chips that current techniques often will not remove.

The equipment used in the current process employed by industry occupies considerable floor space due to the size of most production systems. This precludes an in-line arrangement of the machines, therefore a "batch" handling and a on-pass solution has been employed.

Batch handling is not economically efficient nor desired within the confines of the modem lean manufacturing principles.

Traditional washers require considerable energy to heat the chemicals prior to use, considerable amounts of expensive to generate compressed air, and high costs for surface cooling of the parts and the difficulties in maintaining chemical balance and waste water disposal.

Existing systems have been expanded to incorporate high pressure delivery of the fluids with considerable down time as well as expense associated with repairs and maintenance of the critical components.

Currently employed practices are ineffective to clean the internal critical passageways of the parts.

It is the object of the present invention to provide a cleaning and drying process and apparatus which is effective to remove debris from internal passages with reduced use of compressed air.

It is further object to provide such apparatus which utilizes less floor space, can clean parts as a subassembly with a number of parts installed, and provide continuous high speed cleaning with an in-line arrangement of machines.

SUMMARY OF THE INVENTION

The cleaning process and apparatus according to the present invention involves the technique of creating rapidly repeated pulsing of pressurized air or pressure air and volumes of cleaning fluid driven by air flow directed against th surface of a part to be cleaned. Between the applications of pulses of pressurized air parts to be cleaned are alternately subjected to a vacuum such that any loosened debris and any are immediately evacuated.

The rapidly cycled air pressure and vacuum cause a high velocity reversing fluid flows to be applied to the part, and are created by a generator mechanism in which a rotating vane is used to alternately connect sources of air pressure or vacuum to a series of outlet conduits which lead to tooling which define a cavity in which a part to be cleaned is held. Outlet ports in the tooling receive the rapidly reversing pulses of fluid flow via the conduits to apply the same to specific areas of the part in carrying out the cleaning of the part.

The rapidly reversing flows of pressurized air or fluid is able to effectively loosen any debris even in holes and crevices, which debris is then evacuated out of the tooling with the application of the vacuum.

The vacuum and air pressure may be provided by a complete cleaning system in which a vacuum generator provides both a vacuum reservoir and filed compressed air to carry out the process. Fluid and debris separation equipment can also be included in the return path to the vacuum generator.

DESCRIPTION OF THE DRAWINGS

FIG. 10A is an exploded pictorial view of a single stage rotating valve pulse generator.

FIGS. 12-1 and 12-2 are diagrams of different cleaning flow paths through a part being cleaned.

DETAILED DESCRIPTION

Figure 1:
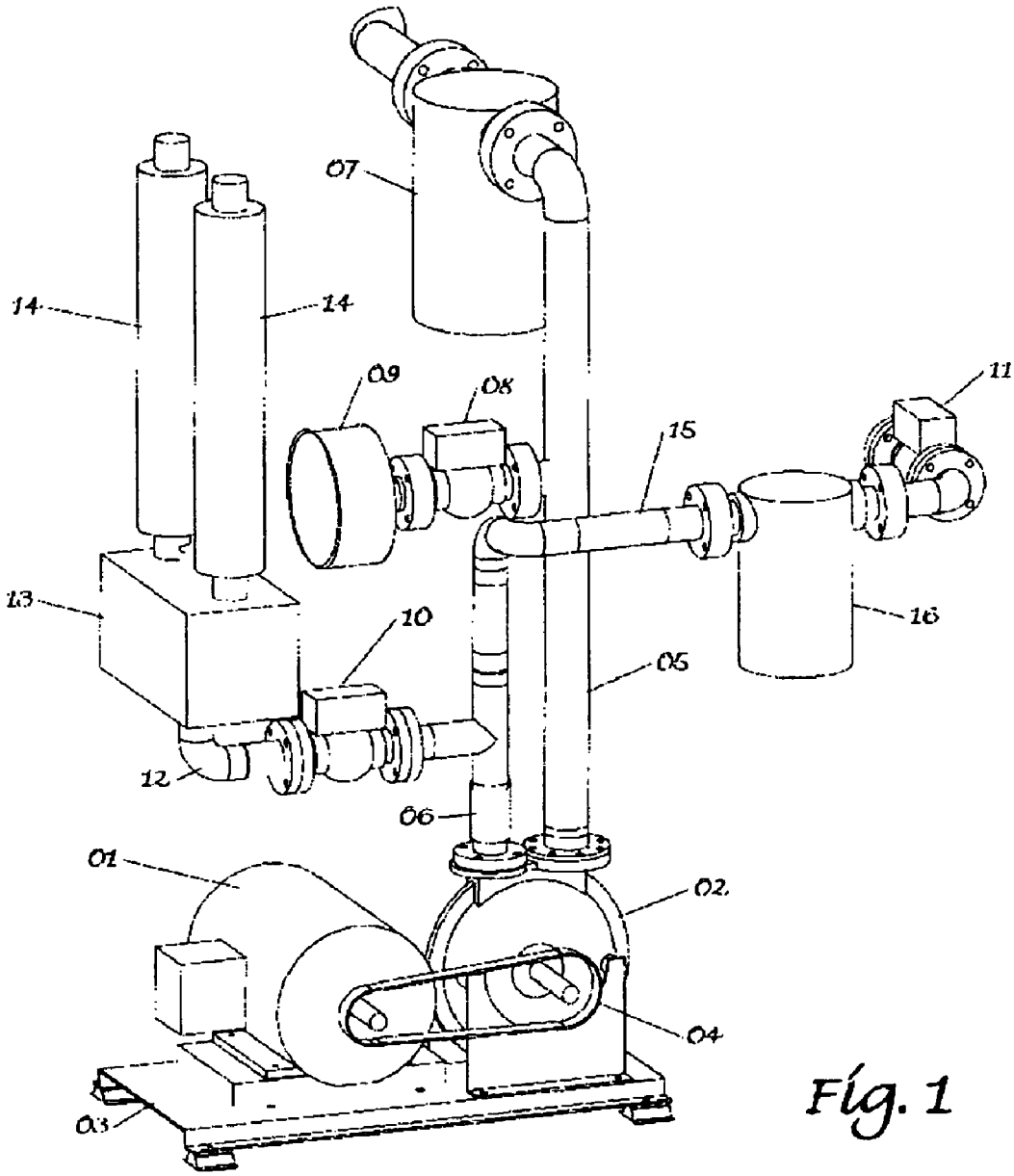
FIG. 1 is a pictorial view of the vacuum/compressed air generator used to provide a vacuum source for use in the cleaning process and apparatus according to the invention.

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

The present invention is particularly directed to cleaning parts being machined for incorporation within other assemblies or subassemblies where the assembly generates debris or contamination as a by-product of handling, manipulation and/or testing. The present invention can provide similar benefits when applied to parts in either a dry or wet environment. The main system can be remote from the area of application allowing a small area to be required for the actual working station carrying out the cleaning process on the part. High air flow velocities created within the present invention allow for extremely short process times which allow the process to be employed at high production rates and with minimal floor space allocations.

The compressed air and vacuum sources required to carry out the process described above can be part of an overall cleaning system described below.

A motor driven vacuum source provides the generation and subsequent air flows associated with the process of vacuum creation in order to provide a conduit for the recovery of fluids and contamination loosened and collected within this process, independent of the volumes of fluids applied in either a simultaneous, alternating, pulsating, or progressive mode regardless of starting position for the cleaning sequence. The vacuum source is operated at a speed dependent upon the drive ratios selected for optimum application performance. The collected and expelled gasses, referred to as exhaust, are typically the compressed air volumes displaced by the vacuum system during the evacuation of the gases from an area which in turn creates the vacuum levels and forces utilized in the collection as well expansion of other compressed air sources utilized with the invented process.

The exhaust side of the turbine vacuum generator, is expelled in either of two manners utilizing selective rotary actuated ball valves. When not utilized in the drying or alternately dry pulsing method, these compressed gases are delivered by connecting pipe runs to a central point collection chamber from which either single or multiple exhaust mufflers are attached for the silencing of the air as it is expelled from the system.

In an alternate arrangement, the selection of the respective rotary actuated ball valves, opening of one which transfers the exhaust gases under pressure to the process, and simultaneously closing the actuated ball valve between the turbine exhaust and the central point collection chamber, now makes these compressed and high flow rate gases available for use in the process for either alternating dry application or for aiding in the drying process of wet parts, or for other purposes required by the application.

The vacuum generator is further connected to an enclosed chamber (upper and lower, first stage separation chamber) of sufficient capacity to withstand the vacuum forces created by it. In order to offset the negative effect of too high of a vacuum being exerted upon this vessel, a bypass valve is mechanically preset to vent the vessel to atmospheric pressure if the set point for the vessel vacuum containment is exceeded. Alternate bypass controls can incorporate readily available flow sensors and electrical outputs to activate via software the same effect.

Air volumes diminished within the enclosed vessel are maintained at a vacuum level by the above means such that with each progressive application upon a part, the system can recover and be prepared to exert the same vacuum force based upon the next cleaning cycle.

Connected by pipe between the vacuum generator and the enclosed vacuum chamber, there is a final stage filtration vessel for the purpose of removing and retaining any residual vapors, mist, moisture, or finite particulates removed by the process within the air flows being drawn toward the vacuum generator. At the bottom of this final stage filtration, there is located a manual or rotary actuated ball valve for the purpose of draining such residual materials as may be collected within the process. Appropriate level sensors are incorporated within this vessel to signal the status of this collection as well as flow rate sensors which detect and monitor the status of the filters. Outputs are utilized to signal and/or control the cleaning of these filters.

The upper and lower, first stage separation chamber contains the vacuum as defined in the invention. Air flows through the vessel under vacuum are filtered within the upper chamber to a specific standard as a result of the finite particulate qualification of the filter medium. All air passing from the vessel must pass through this filter media.

Within the lower area of the chamber, there resides separation flow plates which incorporate attachment to the internal sides of the vessel in an ever diminishing radius. The orientation and diminishing radius of these attachments, utilizes the air flow direction created within the upper chamber to effect a centrifugal motion of all media entering the vessel. Placed at particular locations upon these attachments are wiper plates placed at alternating angles to the direction of the air/media flows for the purpose of skimming the debris and fluids from the main air stream as it passes through the lower chamber and is effected by the generated and circular motion of the materials as they are collected and directed through the vessel. Air flows once separated from the fluids and debris then continue toward the upper chamber area for further filtration as previously described.

In a further embodiment of the invention, the fluids along with any removed debris and contaminants are recovered to a primary chip/debris separation chamber where the debris is filtered and removed from the fluid stream. All effluents effectively stripped from the main vacuum air stream are directed to the bottom area of the lower chamber within this vessel. These materials enter a screening area where debris is restricted from further passage and fluids collected can pass by gravity to a lower sealed recovery area. The chips and other debris collected within the screened portion of the collection chamber can be removed while the system is maintained in production by the closing of a gate directly above the screening chamber. Once closed, the screen is accessible through a side door which when opened, presents the screen in a location for removal. The removal of the screen allows access to the secondary permanent backup filter where any fines may collect. This area can be hand wiped for final debris removal. The screen may also be hand wiped or shaken out for the removal of any debris contained or captured upon it. Once cleaned, the screen is replaced in its position, the access door closed, the flow gate opened and the process returned to full operational status.

Fluids which pass to the lower collection area of this chamber after passing through the filter screen should be free of larger, coarse debris collected within the process, however may still contain material fines which must be removed before the fluids can be reused within the application. Fluid level controls within the collection chamber are used to signal a remote pump connected to this chamber by a pipe. Fluids are removed and pumped to a settling tank after passing through filters where residual oils can reside on the upper surface and any residual fines can drop out of suspension. Fluids removed from this tank are transferred by gravity to a vessel where upon demand, they are again filtered to a finer standard and reintroduced to the pulse generator.

In one aspect of the invention, the recovered fluids along with the supporting vacuum air stream can be automatically returned to a major vacuum recovery system where the fluids are forced from the air stream. Fluids are collected in the lower fluid holding tank until the tank is full. At this time, the lower tank is separated by the automatic closing of the gate from the upper tank, vented to atmosphere and collected fluids are pumped to a primary separation vessel. Fluids can continue being recovered during this transfer stage of the lower fluid holding tank for the continued non-interrupted manufacturing process.

Compressed or vacuum generated exhaust air is also filtered prior to entering the pulse generator as well.

Alternating (i.e., pulsed) delivery of the selected fluid medium is controlled by the motor driven generator referred to above. Speed controls of the motor can be direct driven or in another embodiment of the invention, geared for effecting the appropriate speed required of the process. Speed control of the motor may be fixed or variable through available motor controls. Delivery of the air, vacuum, cleaning fluid, or other mediums being considered appropriate for use enter the generator in a tangential manner relative to the directional flow of the mixed, alternating delivery hose which communicates with the areas to be cleaned. The inside area of the generator is circular and presents four sides, each of which has a port directed at a 90 degree angle from the vertical axis defining the central angel of rotation available from a shaft extending the longitudinal length of the defined circular tube. In a further embodiment of the invention, multiple ports may be arranged to increase the number of flow ports effected by each rotation of the internals of this chamber. Further, the invention can incorporate multiple "stacks" of the above described device as well as differing size orifice areas to effect the required results of fluid delivery/flows to allow one packaged generator capability in cleaning numerous and differing areas of the part allowing each stack driven from either the same or different motors that capability.

Discrimination for the alternating delivery of each medium is controlled within the cylindrical area of the generator by means of a rotating blade of sufficient thickness to effectively block each outlet port and simultaneously receive the differing medias opposed and separated by the blade. The referenced blade is supported by an attached shaft which travels the length of the generator and is centered within it. Each end of the shaft is supported by bearings which locate and center the rotation of the shaft and the captured blade within the center of the generator chamber. One end of the shaft extends beyond the bearing housing to allow attachment to the drive motor. Fluid and air streams enter the generator from opposite directions. Mixed fluid air delivery exits the generator in opposing directions through opposing conduits. The rotation of the internal split blade can be explained in stages.

- Stage 1—Fluid enters chamber from fluid delivery side
  - Air enters opposing chamber from air delivery source
  - Blade is at a centered position blocking the passing of any materials outward from the chambers
- Stage 2—Blade rotates to an offset position either clockwise or counter clockwise
  - Allows received fluid to flow along a passageway toward a conduit at a 90 degree angle from inlet
  - Allows received air to flow along a passageway toward a conduit at a 90 degree angle from inlet
  - Both fluid and air outlets are at 180 degrees from each other.
- Stage 3—Blade follows continued rotation and closes the transfer of medias as defined in Stage 2
- Stage 4—Blade continues to rotate to the opposing off-set position which now allows the fluid flows to align with the same outlet port which preceding this rotation had received a "charge" of air
  - Allows received fluid to flow along a passageway toward this conduit at a 90 degree angle from inlet
  - Blade is presented at the appropriate opposing off-set position which now allows the air flows to align with the same outlet port which preceding this rotation had received a "charge" of fluid
  - Allows received air flows a passageway toward a conduit at a 90 degree angle from inlet
  - Both fluid and air outlets are at 180 degrees from each other Each rotation of the internal directional blade of the generator results in the alternating charge of air over fluid in each of the attached outlet lines. The gross effect of the charge of pressurized air over the previous charge of the fluid medium in an enclosed passageway generates an air over hydraulic pressure effect common with the diameter of the tube restriction. The alternating charges air/fluid/air/fluid etc., are created via the central pulse generator which provides these charges at variable cycle rates based upon each application requirement.

In another embodiment of the invention, a rotating drum is provided which aligns singular straight through ports that allow passage when in the correct and aligned position. Two such drums are linked share a common shaft and each internal port is offset at 180 degrees from the port opening of the other. At the exit side of the drum there is a "T" connection which allows a final conduit connected for the delivery of the mixed materials. Multiple drums can be driven from the same motor source or alternately grouped by size to effect the delivery of the process to multiple areas of a part surface area.

The effective delivery of the mixed media as generated by the above process is contained within the transfer conduit until expelled upon the part surface or other target area. Under normal conditions, there is additional compression of the gas or air portion of the pulses created within the tube as subsequent charges of fluid (non-compressible) are alternately introduced in rapid and continuous succession. The principle of hydraulic compression within the tube elevates the compression of the air charge and when released to atmospheric pressure the additional compression gained within the compressible gas medium accelerates the charge of fluid immediately in front of it at a rate multiplied by the effect of hydraulic compression of the gas. The net impact of this process therefore provides the end user with a resultant process utilizing less compressed air to impart the equivalent forces upon the fluid under existing and available art. This effect is increased to another magnitude when the materials are expelled into a cavity where a vacuum is contained or directed. The increased pressure and speed associated with the delivery of the gases as compressed by the alternating charges of fluid become exposed to less than atomospheric pressures in the presence of the available vacuum. Upon this condition being experienced, the velocities achieved are again greater than available with equivalent fluid flow rates generated by prior art.

In another embodiment of the invention, the consistency as required by the application, dictates that the delivery of the fluids into an intricate part such as a valve body must be maintained in a regulated manner based upon the rate of off-setting fluid/air delivery. In order to achieve the consistent air flow within the system requires an in line flow control system in conjunction with a constantly adjusting device which will detect increased load and self regulates the load to once again achieve the optimum operating parameters. Such systems capabilities as closed loop resides therefore as the feedback of the air flow, translated as a vacuum force which in turn self adjusts to a predetermined set point to maintain the desired cf/hg levels of the application.

The alternating cleaning fluid dispensing, blowoff, and recovery process is contained, directed and can be alternately encapsulated within a formed clam shell using multiple sides to form a box which surrounds the entire part of a surface thereof. Within the enclave, there are ports which direct the fluid application, their recovery by vacuum generation as well as specific ports directed at the recover of small debris, chips, lodged within bolt holes, internal passageways, or other recesses.

The enclosed clam shell tool contains internal conduits which deliver and maintain the generated vacuum force upon the part as well as provided the directed delivery orientation of the alternately delivered pressurized air or other fluid so as to impart both a push as well as pull upon the part surfaces thereby enhancing the Bernoulli effect for the purpose of gaining rapid orientation and redirection of fluids at increased speeds for optimized surface cleaning. The orientation of the air/fluid delivery ports within the tool are at a predetermined position, so as to impart a focused fluid delivery pulsing into critical areas where chips and other contaminants can form. Direction for removal of the supplied materials as well as the contaminants removed by the process is a function of the location of the vacuum pick-ups also located and placed within the clam shell fixture.

By the use of the optimized orientation and as well as flow control, the part may be loaded into the fixture either manually or within the confines of automation and manipulated in a totally sealed and environmentally safe manner. Orientation of the part is not a priority as the forces applied do not rely upon gravity thus allowing alternate orientation of the part, the transfer system and other subassemblies as thus enhancing high speed automation of the part assembly. The use of the exhaust gases from the vacuum source or pressurized air from an alternate source can be concentrated within the tool such that in addition to a mechanical means of pulsing the air flow through the part both before washing fluids are dispensed, as well as after such that cavitations of the fluid/air flow pulsed air effect can exercise debris from the parts, and aid in their removal. Unique sealing of the tool as well as the confines of the fluid/air flow passageways within the dispensing devices provides for consistent delivery of the pulsed air air/fluid to critical internal passageways and in another embodiment of the process external surface areas. Tooling is constructed in such a manner as to provide a full face contact seal on all sides of the part or the surface area to be cleaned. This clam shell design allows for the controlled vacuum force to be maintained for optimized residual materials collection simultaneous to the application of the pulsing fluid/air medium.

Intricate parts as well as recess cavities which are prone to contamination collection can now be cleaned without high pressure cleaning system which require excessive floor space, maintenance, and initial capital investment.

Subassemblies can receive selective cleaning during the assembly process inline with lean manufacturing principles.

The invention conserves energy through the use of fluid delivery generated with less expense than the prior art depicts.

The invention utilizes fewer moving parts than the prior art machines to accomplish the same if not better results.

The invention provides a means to simultaneously collect debris once loosened from the part whereas the prior practice allows the contamination to reenter the area it was displaced from allowing the part by way of prior art process to become recontaminated.

The tool placement and key target surface contact areas tend to create an assembly which contains fewer operator induced defects. The preorientation effect pulsed-air minimizes misaligned or scored components which would previously contribute to defective parts later in the manufacturing process. Automation down stream of the cleaning operations can concentrate upon assembly rather than redundant quality checks.

An integrated cleaning system may include dedicated air pressure and vacuum sources and certain recovery-separation equipment for handling of debris and used cleaning fluid. The vacuum operator can also provide compressed air used in the process.

This peripheral equipment will here be described first.

Referring to FIG. 1, a motor 1 of sufficient capacity to drive the vacuum generator 2 is mounted to a frame 3 such that connection between the motor 1 and the vacuum generator 2 can be geared by drive gears and driven by a connection drive belt 4.

By motor drive and rotation, the vacuum generator 2 creates the vacuum forces internally by the displacement of air and presents the generated vacuum for use in the process at inlet 5. In order to minimize excess vacuum build up within the vacuum generator 2, the vacuum generator 2 is connected to a ball valve 8 which is placed inline with the conduit leading to the vacuum generator 2 from the final stage filter 7. Air entering the vacuum generator 2 during this bypass sequence is filtered prior to reaching the ball valve 8 by an attached filter 9.

The air being displaced is generated as a compressed exhaust gas and discharged through the exhaust port 6. The directional control of the exhaust is controlled by open/close position of ball valves 10 and 11. In the bypass mode of operation, ball valve 111 would be closed and ball valve 10 would be open. Under this condition, the exhaust gases would be transferred through ball valve 10, through the attached and connected pipe 12 to be received within an exhaust collection box 13. The exhaust collection box 13 is in turn connected to multiple silencers 14 prior to the final discharge of the exhaust gases to atmosphere.

Under the normal operating conditions of the process, and when called upon as part of the process application requirements, the exhaust gases are diverted toward the process by closing ball valve 10 and opening ball valve 11. The conduit 15 which becomes charged with the compressed exhaust gases maintains an inline filter 16 for the purpose of finite cleaning all air streams employed by the process.

Figure 2:
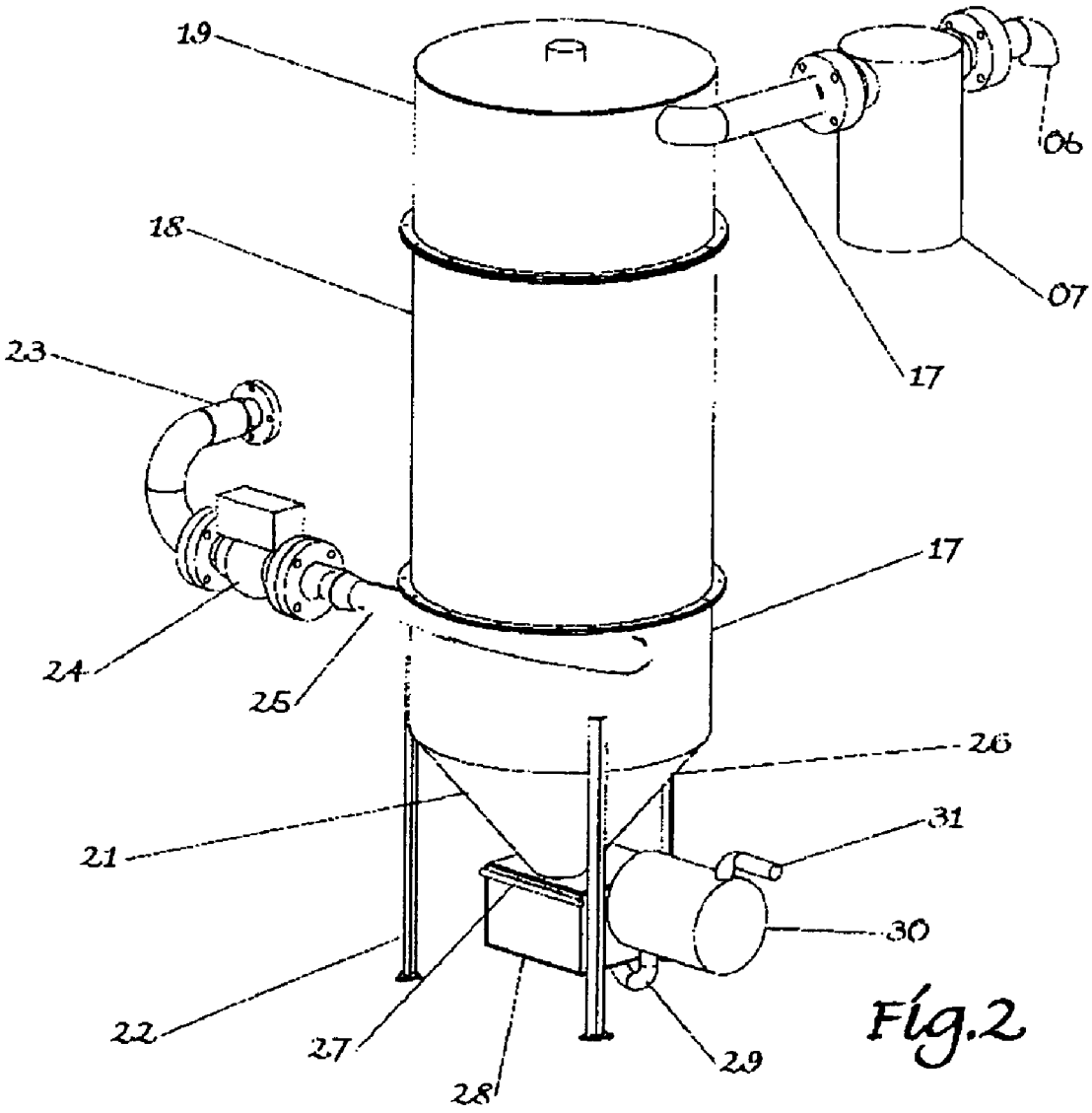
FIG. 2 is a pictorial view of a recovery apparatus used to collect and separate fluid and chips generated during the cleaning process of the present invention.

Referring to FIG. 2, the vacuum generated by the vacuum generator 2, is initially held within the first stage separation chamber 18. The vacuum is communicated to the active process through piping 23 and the directional flow of debris and materials utilized within the process are allowed access to the first stage separation chamber 18 by a controlled ball valve 24. When ball valve 24 is opened, the flow control of air being consumed as a regenerative power source for the inverted process is also available by the synchronous opening of the ball valve 11. Under the normal mode of operation, the debris and cleaning materials utilized within the inverted process are transported by piping 25 into the lower area of the first stage chamber 20. Within the lower chamber 20 there are resident internal plates 26 which separate the main air stream from the fluids being received. Air flow is pulled toward the upper area of the first stage chamber through the upper chamber area 18 and subjected to internal filter media. After filtration within the chamber 18 the filtered air is collected in the upper area 18 and subjected to internal filter media. After filtration within the chamber 18 the filtered air is collected in the upper area of the first stage chamber 19. These air flows are further evacuated from the first stage chamber by connection to pipe 17 and subsequently subjected to a final stage filtration 7 where any contained debris of a more finite particulate size is collected before the cleaned air stream is passed on toward the vacuum source through pipe 5.

Fluids and debris collected and separated within the lower chamber 20 continue to fall out of suspension during the high vacuum cycle created when ball valves 24 and 11 are both closed. At this stage of the process the collected materials are directed through a chamfered cone 21 into the chip collection chamber 28. Coarse filter screens are used to separate the more coarse media collected within the process and are removable for cleaning through doorway 27. Fluids continue through the screen areas to the bottom of the chip collection box 28 which is sealed on all six sides and allows the fluids to be delivered into pipe 29. These fluids are then exposed to pumping pressures generated by pump and motor 30. These materials and any contained debris are then transported by pipe 31 to a secondary storage separation tank 32.

Figure 3:
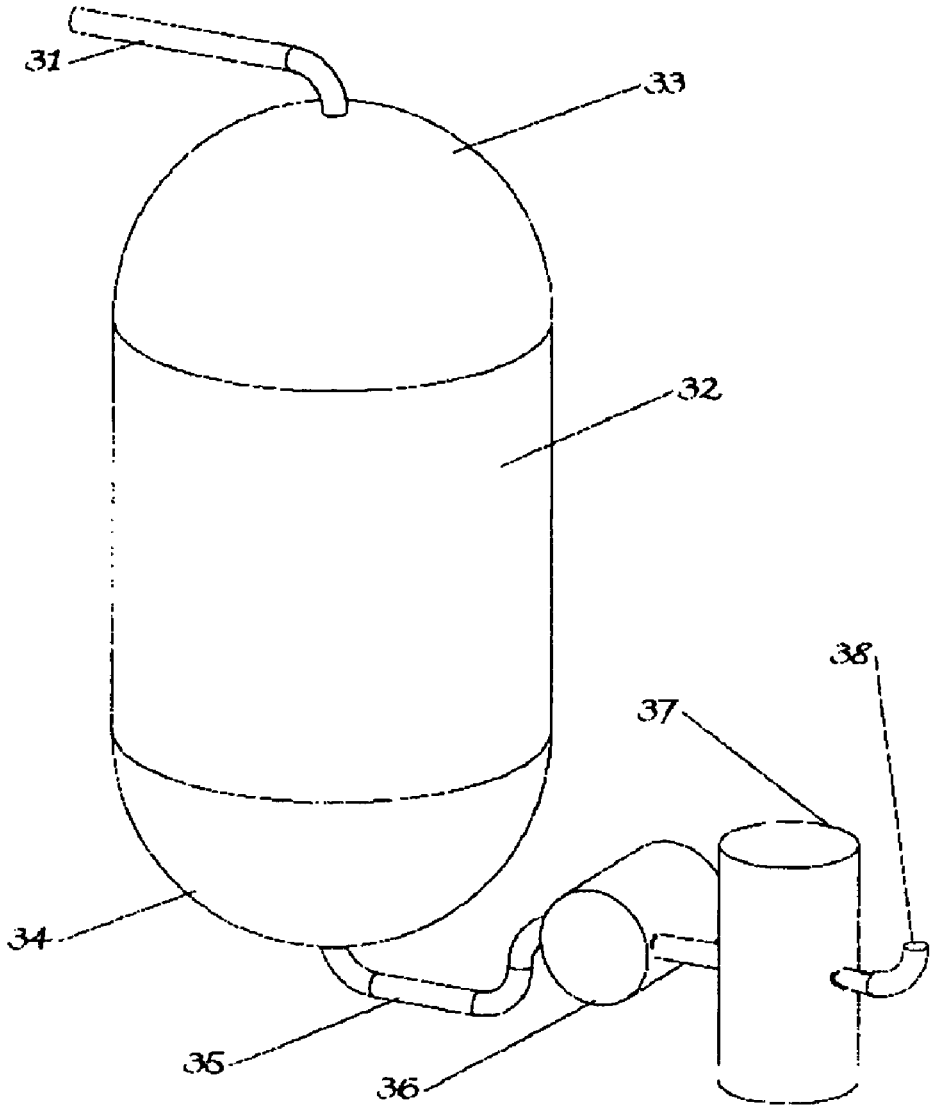
FIG. 3 is a pictorial view of a fluid dispenser used to supply a cleaning fluid for use in the cleaning process according to the present invention.

Referring to FIG. 3, fluids and residual finite debris are received within the fluid separation holding vessel 32. Retained within this vessel, oils and other floating debris are contained in the upper area of this tank 33. Fluids being recovered for reuse begin filling the lower area of the vessel 34. These fluids are allowed to settle out so that those materials which are transported from the tank through pipe 35 are in turned pumped upon demand by a motor driven pump 36. Fluids thus pressurized by pump 36 are directed through a finite filtration vessel for the removal of any finite debris and contamination. Once passed through this filter 37, they are then transported by pipe 38 to the operational stage of the process according to the invention.

Figure 4:
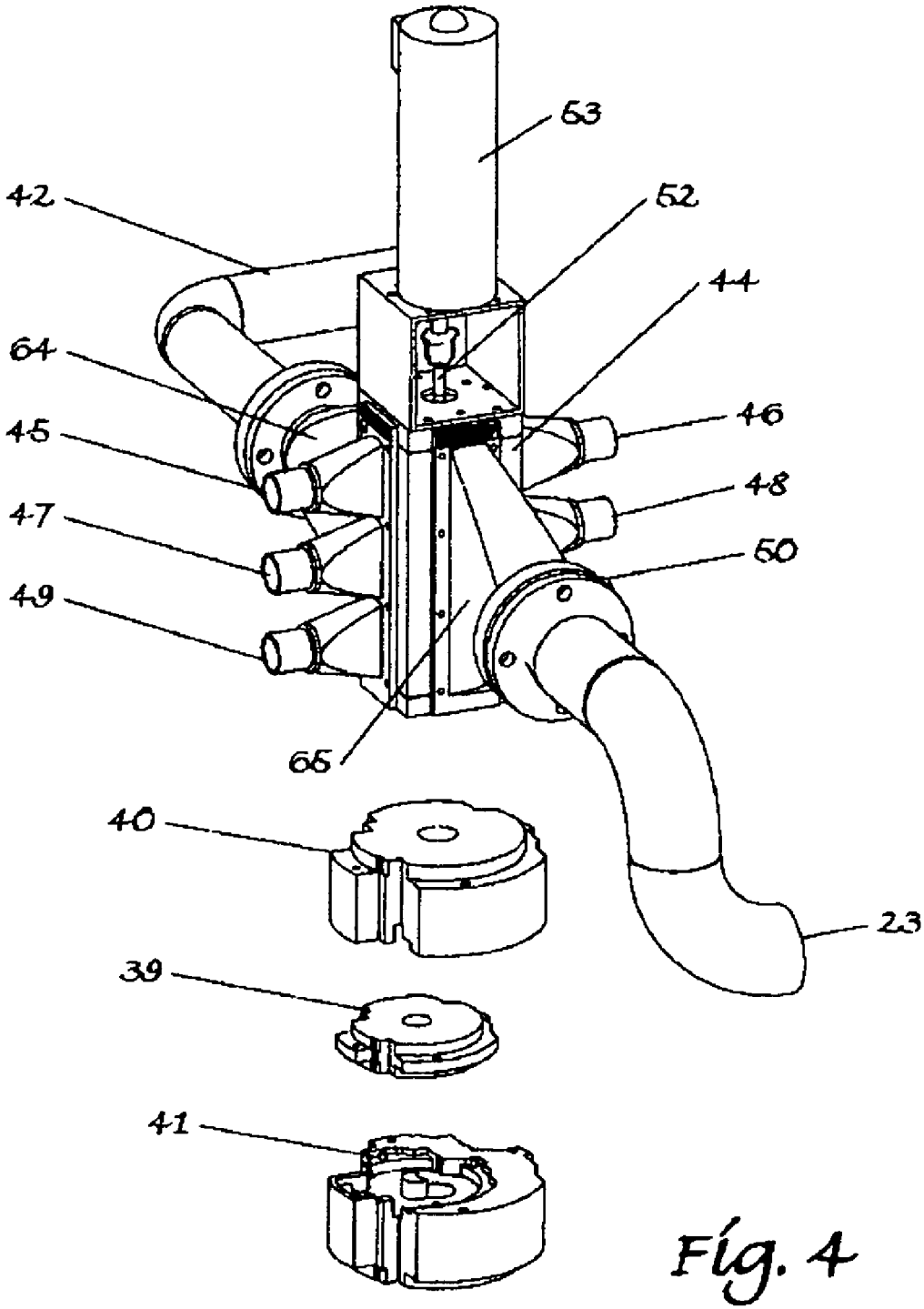
FIG. 4 is a pictorial view of a pulsed fluid generator used to clean a part enclosed in an upper and lower tools, also shown in a exploded pictorial view.

Referring to FIG. 4, a typical part 39 to be cleaned is captured between two mating cast tooling pieces, an upper piece 40 and/or lower piece 41. In an alternative application of the process, either the upper and/or lower pieces 40, 41 may be incorporated within the process. Within the tooling pieces 40 and 41, there are formed passageways which direct the flow of the pulsed fluids being delivered from the active fluid pulse generator. Additionally, vacuum which is stored in the first stage collection vessel 18 is directed into the process through pipe 23. Exhaust gases compressed by the vacuum generator 1 are presented at the opposite side of the pulse generator 44 through pipe 42.

Attached to the pulse generator 44 are opposing ports 45-46, 47-48, 49-50. Each port is linked by flexible, non-collapsing tubing to either of the capturing tooling pieces 40, and/or 41, in such a manner as to align with the ports presented within these components. The functioning of the other ports 45, 47, or 49 as a vacuum port or alternately as a pressure port is determined by valving comprised of the rotating internal separation blade 51 acting as a valving member. This blade is attached to a shaft 52 which is in turn rotated by a motor 53 coupled with the shaft. A variable speed motor 53 is incorporated in the process. Through each rotation, and at 180 degrees of separation, the blade 51 blocks the inlet as well as the outlet presented internally within the pulse generator 44.

At the following rotational position of 10 degrees, from this predefined start point, the blade 51 allows vacuum to be transferred to ports 45, 47 and 49, while exposing ports 46, 48 and 50 to the compressed exhausted gases presented via pipe 42. Vacuum generated by this means as well as the compressed air generated by the process is then presented to opposing chambers within the part tooling piece 40, 41 and exposed to the part 39. Rotation continues until the blade 51 again achieves a 180 degree position thus blocking either vacuum or pressure to enter the pulse generator 44. Subsequent and upon achieving another 10 degrees of rotation, the blade then allows for the reversing of the previous condition and presents pressure to be diverted toward ports 45, 47, and 49, while alternately exposing ports 46, 48, and 50 to the vacuum source 23.

The rate of rotation of the blade 51 controls the pulsing frequency which is variable to the particular applications 100 to 200 cycles per minute being typical.

Figure 5:
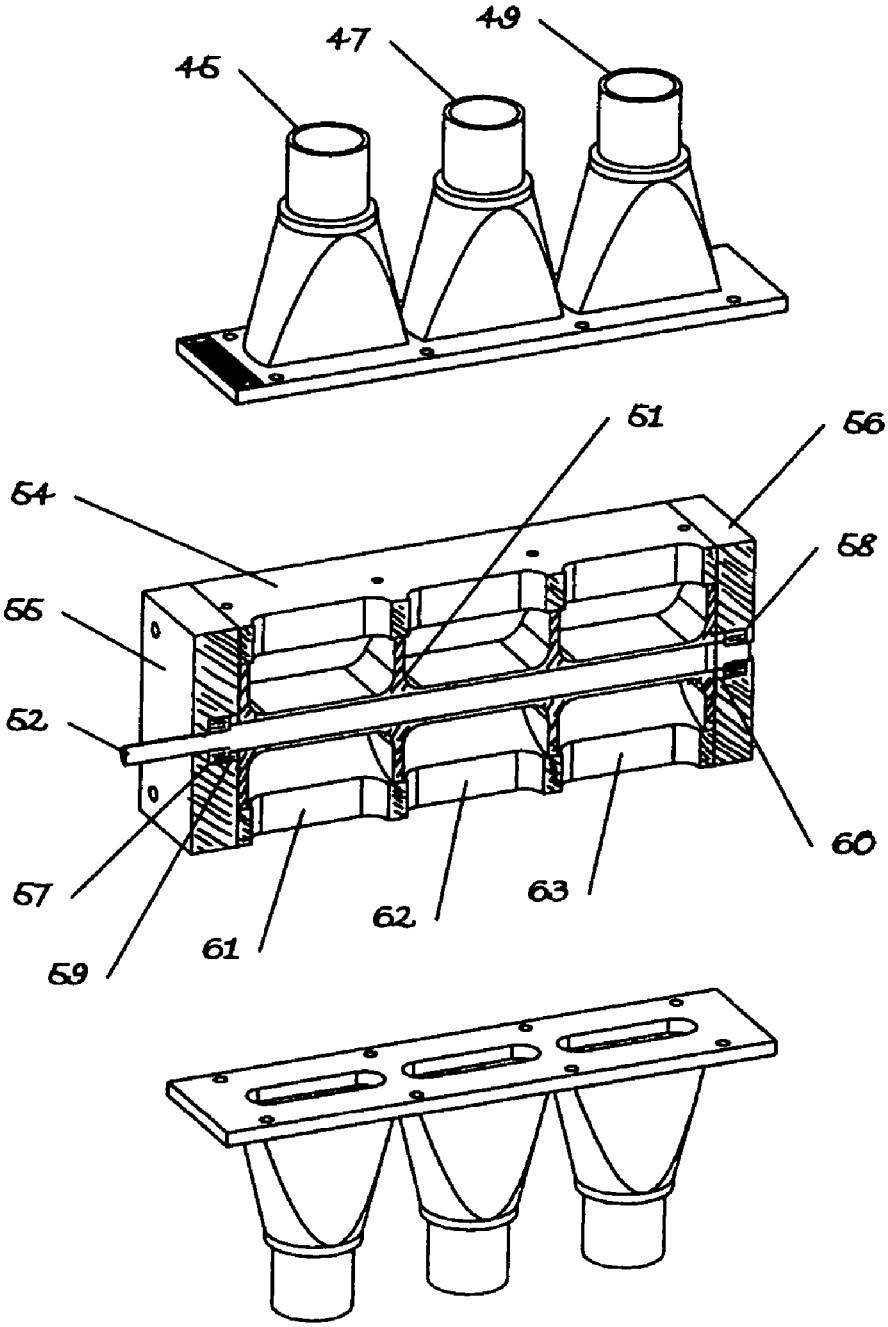
FIG. 5 is an exploded partially sectional pictorial view of the pulsed fluid generator.

Referring to FIG. 5, the pulse generator is comprised of an internal housing 54 of sufficient bore presented in the longitudinal direction to accomplish the prescribed process. Each end of the housing 54 is sealed by an affixed end plate 55 and 56. Each end plate presents a means for supporting and centering the rotating shaft 52 which is press fit to become fixed to the rotating blade 51, by means of a bearing supported at the top 57, and a bearing centered at the lower end plate 56 noted as item 58. Bearings 57 and 58 are protected by the placement of seals within the end plates 59 and 60. Ports 61, 62, and 63 are manufactured in alignment with the ports presented in the manifolds 45-46, 47-48, 49-50. Likewise, the main delivery manifolds 64 and 65 are accessed in a similar means.

The rotation of the blade 52 within the pulse generator 44 discriminates the directional flows as exerted within the tooling pieces 40, and/or 40 and 41. These flows are reversing as described above and enhanced by the stored energy discharge which occurs during the 180 degree blocking instance created when blade 51 intersects and closes the directional port flows to ports 45-46, 47-48 and 49-50.

Figure 6:
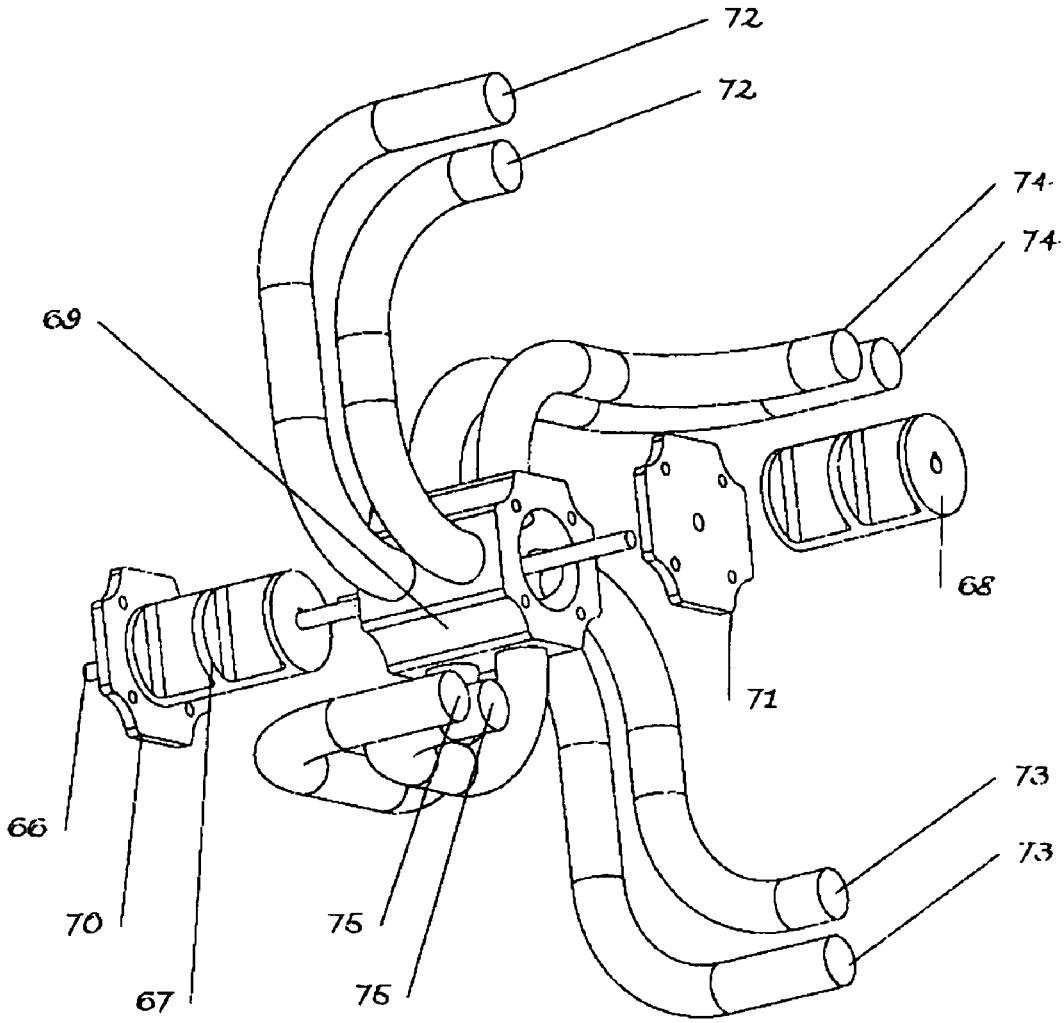
FIG. 6 is a partially exploded pictorial view of an alternate embodiment of the pulse generator shown in FIG. 5.

Referring to FIG. 6, in a further embodiment of the invention, fluids and alternately compressed air can also be injected into the process for enhanced debris removal from inaccessible areas of the part 39, such as tapped holes or internal passageways, as well as interior and exterior surface preparation of the part 39. In a means similar to that described above, a motor driven shaft 66 is attached to a rotating blade 67. Again as described above, the attached assembly shaft 66 and blade 67 rotate within a housing 69 sealed at each end by an end plate 70 and 71. In an alternate embodiment of the process, plate 71 could become a middle separator plate and additional blades 68 and housings 69 could be employed to provide additional port outlets for multiple application targets.

Fluids, delivered from pump 36 enter the housing through piping in conjunction with ports 72 opposed 180 degrees from ports 72 which receive plant supplied compressed and regulated air through a similar conduit. Delivery of the alternating charges of air and fluid are discriminated for delivery by the rotation of the blade 67 captured within the housing 69. When ports are in open flow status caused by the blade 67 partially rotating past the blocked area of housing 69, port and attached pipe run 74 would receive a flow of air and port and pipe run 75 would conversely receive a charge of fluid. Subsequent to the continued rotation of the shaft 66 and blade 68 the reversal would occur as now the blade 67 closes the inflow of materials from attached pipe runs and ports 72 and 73. Continued rotation of the blade 67 causes the blade 67 to rotate past the blocked area of housing 69 where it becomes aligned with port and attached pipe run 75 which would now receive a flow of air, and port and pipe run 74 would conversely receive a charge of fluid.

The alternating charges described are then transferred to the part 39 by connection to pipe runs 74 and 75 via attached hose assemblies 76 and 77, respectively. Hoses 76 and 77 are then attached to the respective locations within the tooling pieces 40, 41 which target areas of the parts 39 for cleaning.

Alternating vacuum and reversing air flows generated within the tooling pieces 40 and/or 40 and 41 provide the means for agitation and escapement of the debris being loosened by the process, thus providing a means by which not only is the debris removed from the immediate surface area of the part where it was located, it is further removed from the entire area of the part in a manner which prevents it from reengaging the part in a different area.

Figure 7:
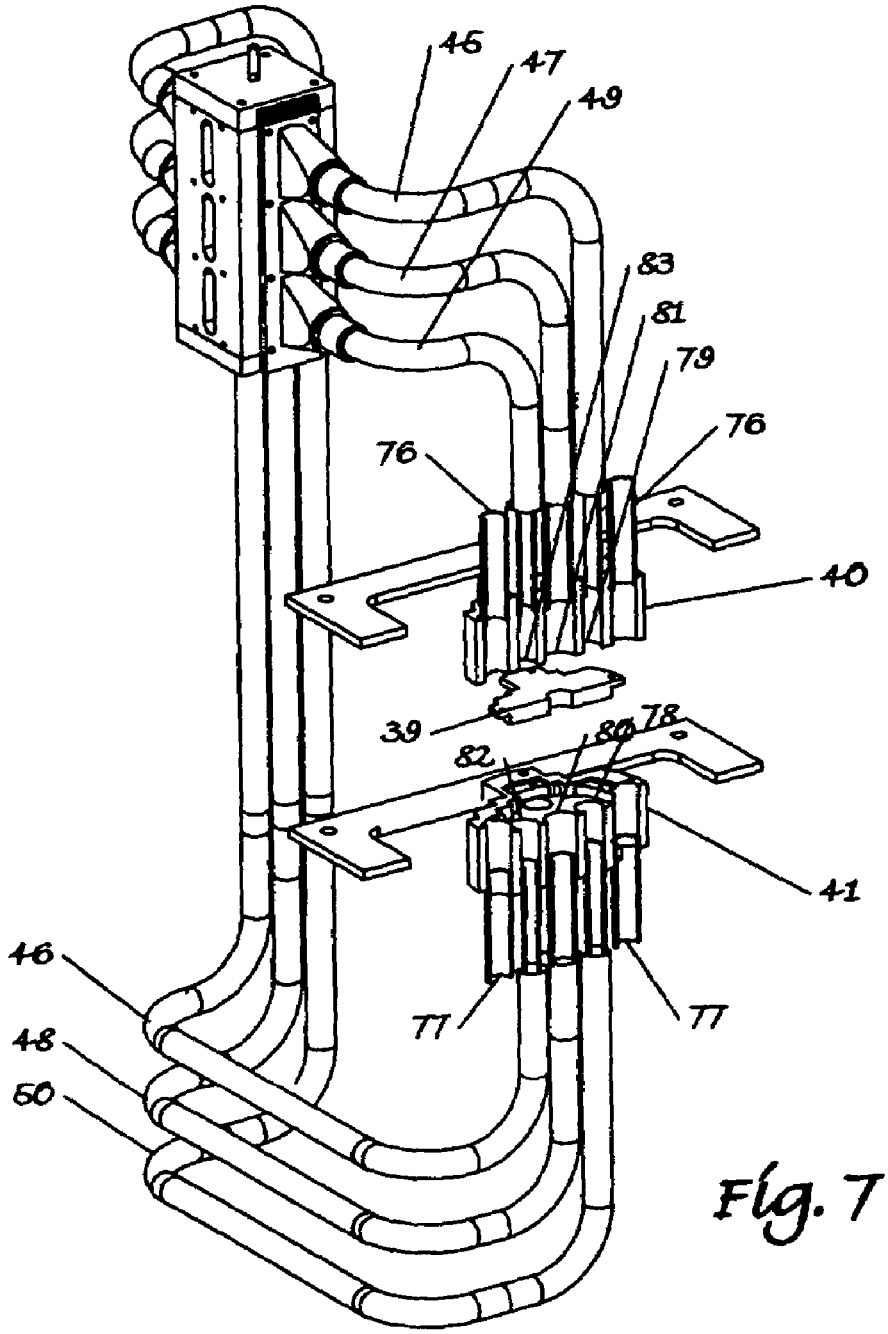
FIG. 7 is a pictorial partially exploded and sectional view of a pulse generator, connecting conduits, and tooling used to enclose a part and direct pulsed fluid to particular areas of the part.

Referring to FIG. 7, the mechanical transfer of the part 39 into tooling shown therein can be either manual, or utilize a transfer device. The location of the part 39 is controlled by custom designed tooling pieces 40, 41 which have a part cavity. Once placed and nested within the cavity, the part 39 is enclosed within the upper and lower cavities 40 and 41, which also contact each other to create a sealed enclave housing the part 39 and compressed air to be delivered by pipe runs 45, 47, 49, 46, 48, 50 as well as the alternating fluids and compressed air being delivered by pipe run connections 76 and 77.

Once sealed between the upper and lower tooling pieces 40 and 41, respectively, the process begins by the discriminate delivery of compressed gases through pipe runs 45, 47, and 49. Simultaneous to this is the delivery of vacuum through pipe runs 46, 48, and 50. The vacuum is the lower surface area of part 39 at locations 78, 80, and 82 is then exposed to the vacuum. The corresponding area of the part 39 when seen from the top likewise is exposed to pressurized air at locations 79, 81, and 83. The described forces create a directional air flow across and through the part area where exposed.

The continued rotation of the blade 51 within the pulse generator housing 44 orients the directional flow of the compressed gases entering through port 64, to now be directed through internal passageways 61, 62, and 63 which due to this rotation now align with and provide compressed gas pressure delivery through pipe runs and ports 46, 48, and 50. Likewise, as a result of this rotation, pipe runs and ports 45, 47, and 49 now receive the vacuum forces provided by vacuum plenum 65.

The displacement by volume of the air flows generated within this process occur at each revolution of the pulse generator blade 51, thus providing total escapement of any contaminants and debris being loosened by the delivery of alternating fluid and air provided within the upper piece 40, and lower piece 41 of the tooling by pipe runs and conduits 76 and 77.

Figure 8:
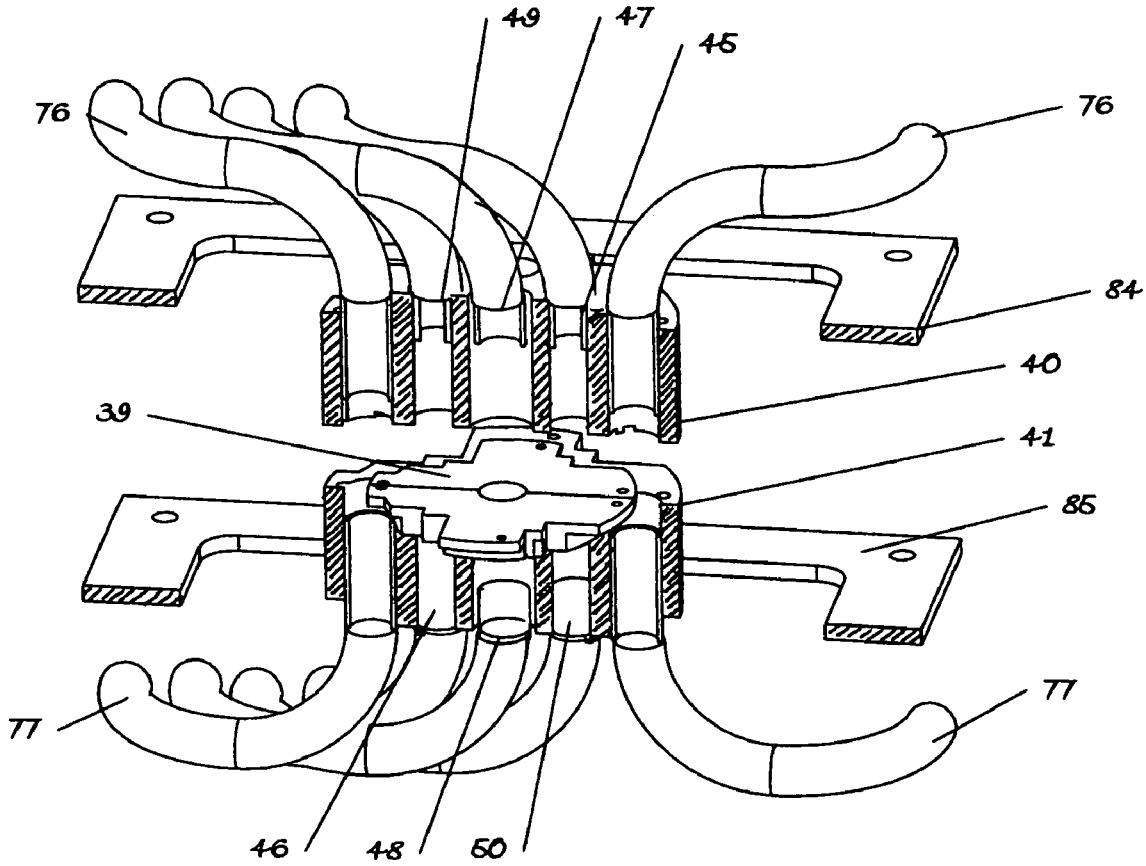
FIG. 8 is a partially exploded and partially sectional view of tooling halves and attached conduits as well as an enclosed part.

FIG. 8 represents a more detailed view of the process as provided in FIG. 7. To further clarify, the upper tooling piece 40 is attached to a carrier plate 84 in a parallel plane to the lower tooling piece 41 and its associated and mounted carrier plate 85. In a normal version of the process, these plates 84 and 85 would be separated the distance required to allow the insertion of the part 39 in the lower tooling piece 41.

Figure 9:
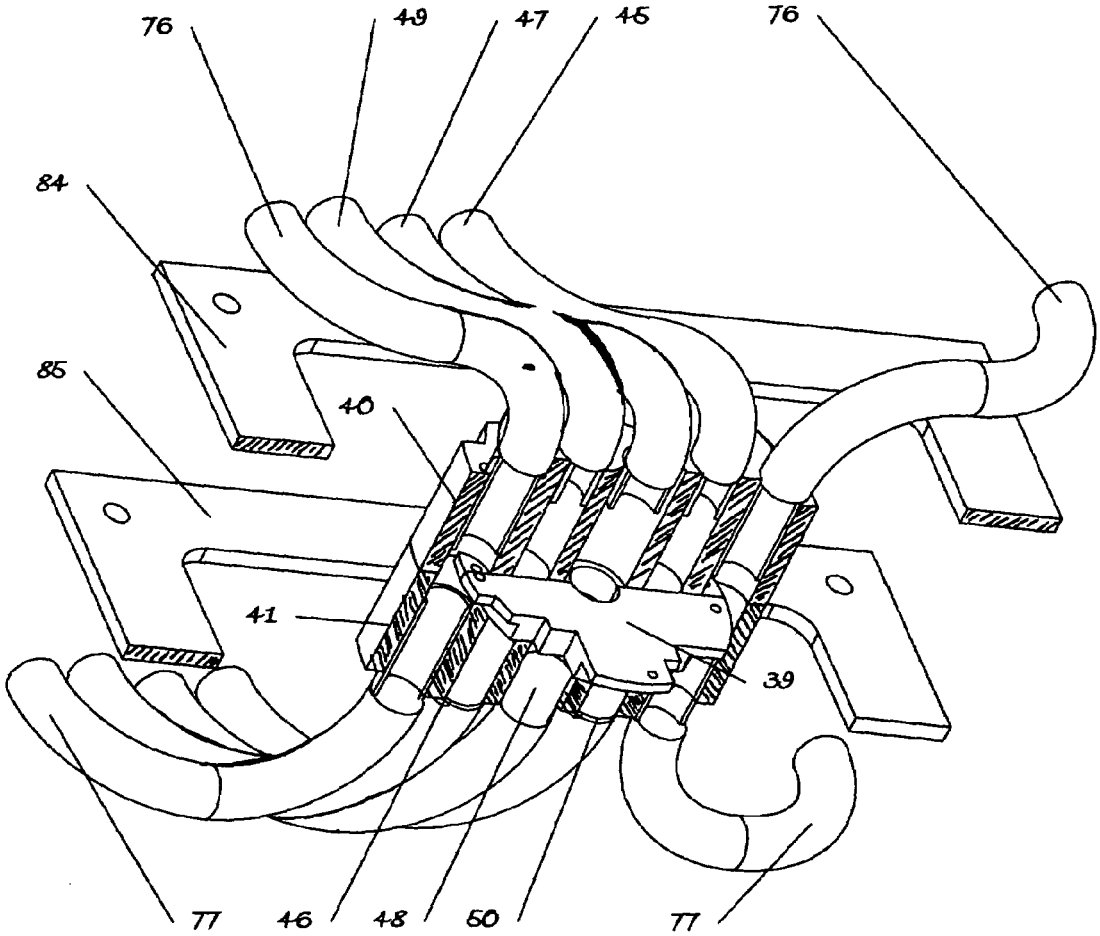
FIG. 9 is an enlarged pictorial, partially exploded view of the tooling shown in FIG. 8, showing additional details.

Referring to FIG. 9, once the part 39 has been placed into the lower tooling piece 41, either the lower tooling piece 41 and its attached carrier 85 will be manipulated toward a closed position at which time the lower tooling piece 41 and the upper tooling piece 40 are in direct and sealed contact face to face.

The process of pulsed fluid delivery then occurs by the initial and alternating supply of the fluids and air via conduits 76 and 77. The alternating effect of the fluids being delivered provides the agitation of the ports surface areas and cavities for the displacement of the contamination to be removed.

Simultaneous to the delivery and discharge of the alternating pulses through conduits 76 and 77, air flows are being generated and delivered through ports 49, 47 and 45 and being recovered under vacuum via ports and conduit 46, 48, and 50.

By this means, not only are the materials removed from the surface areas, both internal as well as external to the part 39, they are subsequently evacuated so as not to recontaminate the part 39 being cleaned. Likewise, debris removed in this manner may be recovered for proper disposal or reuse as in the case of the regenerated and filtered exhaust gases and recovered fluids.

Figure 10B:
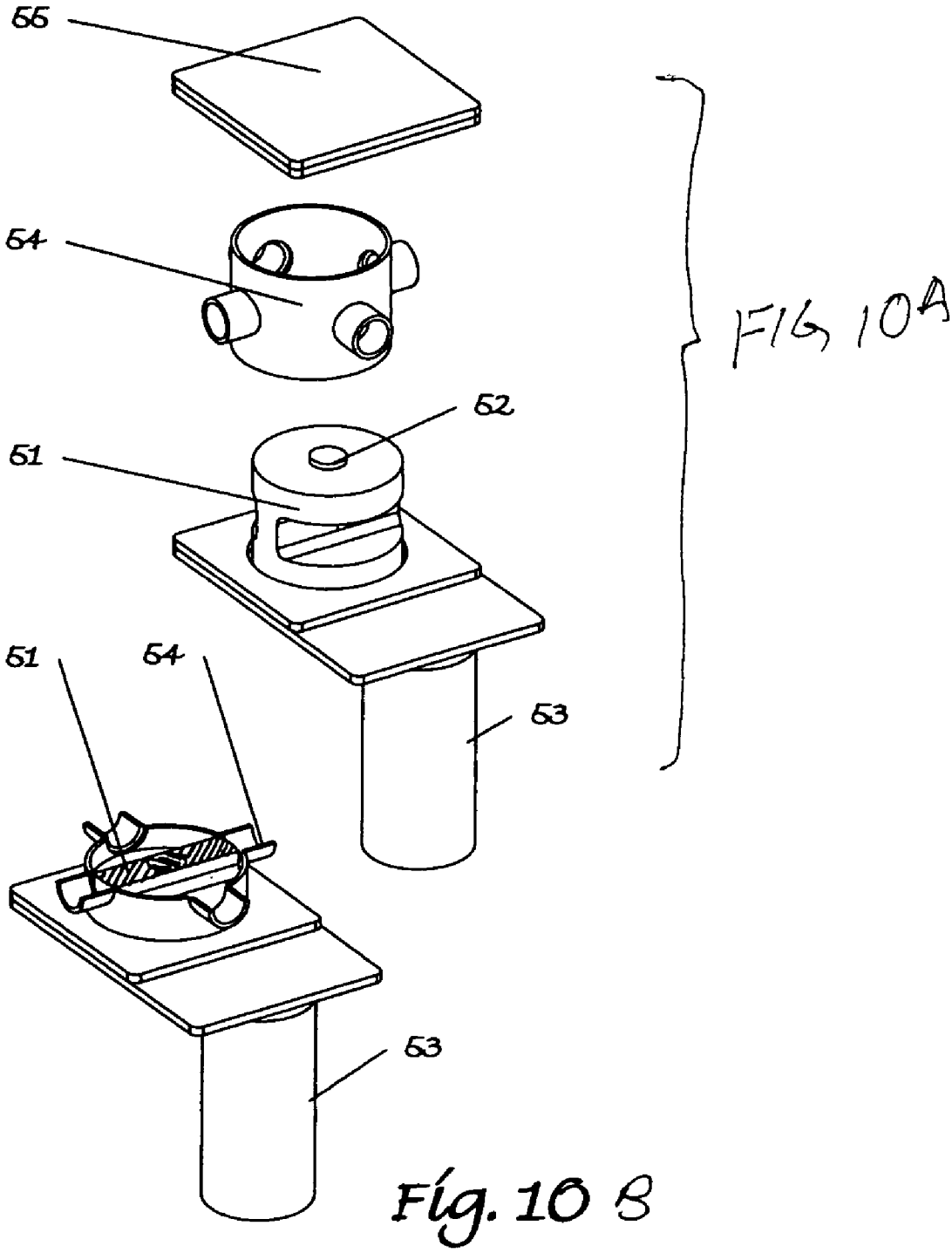
FIG. 10B is a partially sectional view of the single stage rotating vane generator shown in FIG. 10A.

Referring to FIG. 10, the flow schematic attached represents the flow and recovery of the basic pulsed air, defined as the exhaust and vacuum air source provided within the process. Displacement and use of these air flows can be either through the part 39, across the surface areas of the part 39, or alternately within part cavities, holes, or inaccessible areas or finally in a combination of the above.

Figure 11:
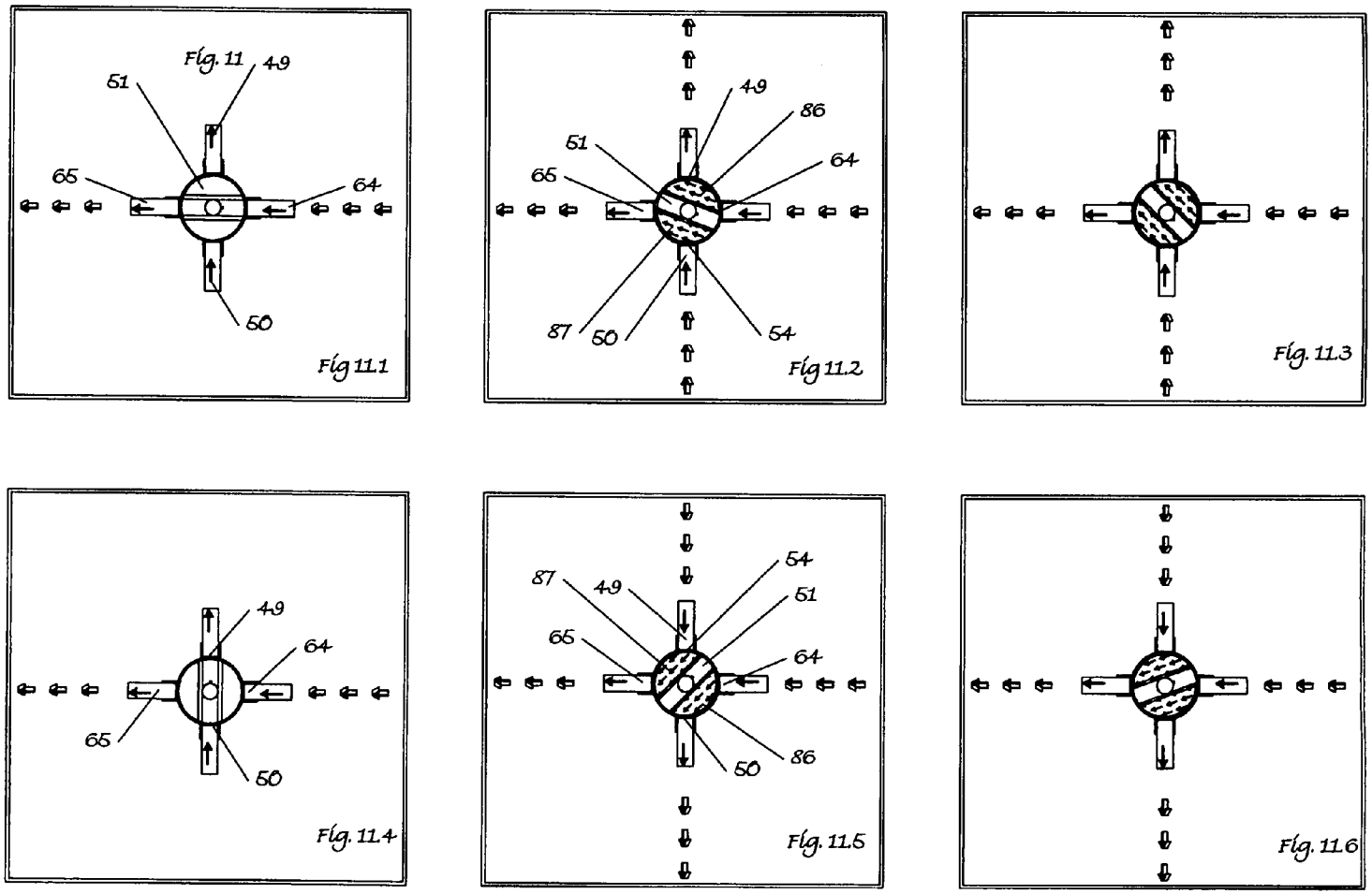
FIGS. 11.1-11.6 are diagrams showing successive states of the pulse generator valving.

Referring to FIG. 11, the flow schematic represents the flow, recovery, and recirculation of the fluids recovered within the defined process. Displacement and use of the alternating air and fluids can be either through the part, across the surface areas of the part, or alternately within part cavities, holes, or inaccessible areas or finally in a combination of the above.

Referring to FIG. 10, a further description of the process, the reversing, and alternating, evacuating air flows can be observed in a transverse sectional view of a generic single drum pulse generator assembly as described in FIG. 5. In the referenced FIG. 10, the upper plate 55 is detached from the housing 54 providing a perspective view of a single blade 51 driven by shaft 52 which is in turn connected to motor 53. The transverse section of the blade 51 is observed in a likewise transverse view of the housing 54. The rate of pulsing is variable, but typically would be 100-200 cycles per minute.

Referring to FIG. 11, in a top view of the pulse generator assembly the rotation of the internal blade comprising a valving member shown as a cross sectional transverse view in FIG. 10 is depicted in a clockwise rotation however in the embodiment of the process it could be counter clockwise as well and resulting in the same effect. In FIG. 11, a vacuum source is connected to and remains active with port 65. The regenerative compressed air source also remains active and is connected to port 64. FIG. 11 depicts the blocked condition where upon rotation of blade 51, the width of the blade 51 creates a seal to the active ports 64 and 65. As this position, the vacuum force is retained and builds within the conduit and port 65 and likewise the pressure increases within conduit and port 64.

In FIGS. 11.2, subsequent to the next moment of rotation of blade 51 in the clockwise rotation, the kinetic stored energy of pressure is then directed through port 49 by a recess 86 cut within the blade 51. This occurs as the recess 86 finds alignment with port 49 which then provides an unobstructed delivery of the compressed air provided through port 64. Simultaneous to this rotation, the vacuum forces stored and building kinetic energy within port 65 gain unobstructed access to port and conduit 50 by the alignment of the recess 87 within the housing 54 as presented by rotation of blade 51.

In FIG. 11.3, continued rotation of the blade 51 presents an on-going and unobstructed flow as described in FIG. 11.2.

In FIG. 11.4, the continued rotation of the blade 51 once again creates a blocked condition where upon rotation of blade 51, the width of the blade 51 creates a seal to the outlet ports 49 and 50. Once again, at this position, the vacuum force is retained and builds within the conduit port 65 and likewise the pressure increases within conduit and port 64.

In FIG. 11.5, subsequent to the next moment of rotation of blade 51 in the clockwise rotation, the kinetic stored energy of pressure is then directed through port 50 by a recess 86 cut within the blade 51. This occurs as the recess 86 finds alignment with port 50 which then provides an unobstructed delivery of the compressed air provided through port 64. Simultaneous to this rotation, the vacuum forces stored and building kinetic energy within port 65 gain unobstructed access to port and conduit 49 by the alignment of the recess 87 within the housing 54 as presented by rotation of blade 51.

In FIG. 11.6, continued rotation of the blade 51 presents an on-going and unobstructed flow as described in FIG. 11.5.

Upon continued rotation blade 51 will once again achieve the position as noted in FIG. 11.1 and the end of one rotational cycle, resulting in a complete pulse and reversal will have occurred.

Figure 12:
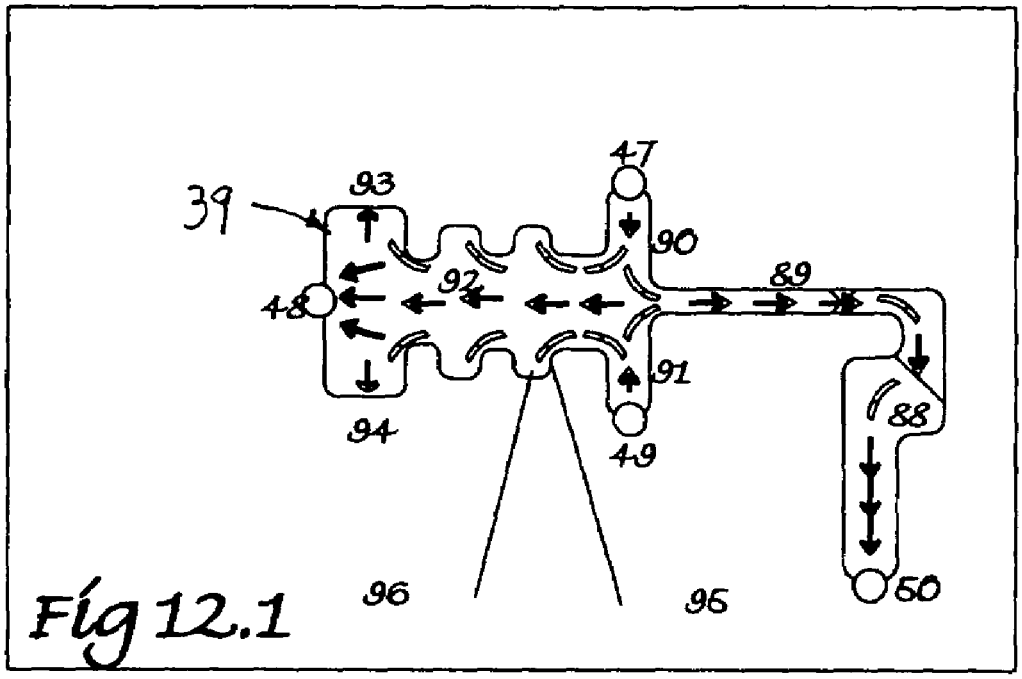
Figure 12:
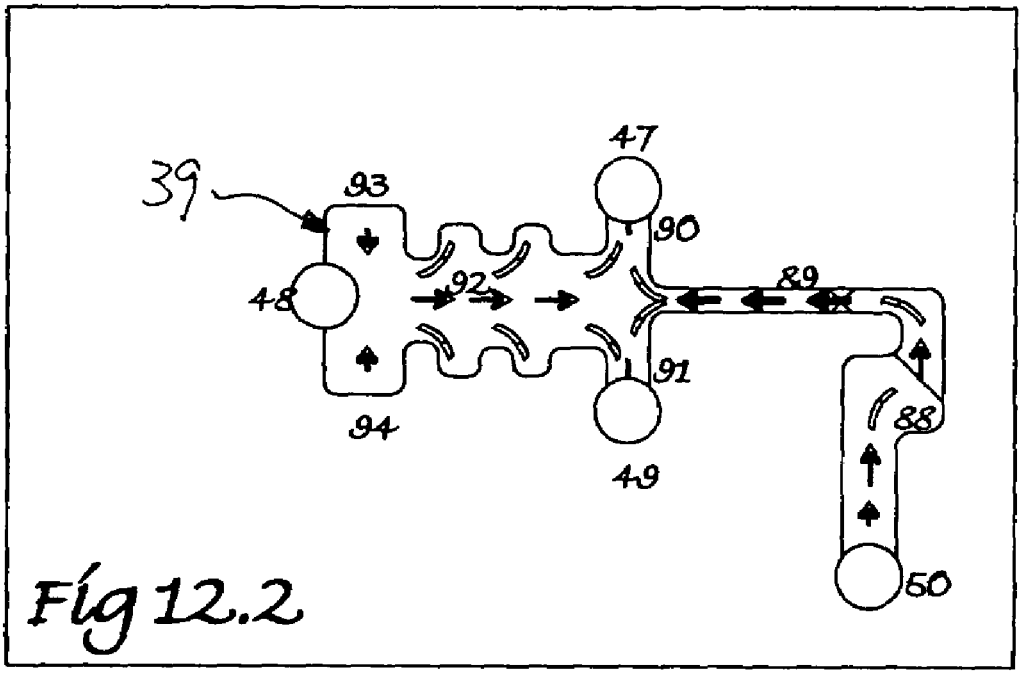

Referring to FIG. 12.1, the reference figure depicts the combined air flow generated by the initiation and completion of the first phase of a pulse cycle as depicted in the above referenced FIGS. 11.1 through 11.6 above. A specific partition of part 39 is depicted in a transverse sectional view as it would be exposed to the processes created by the process and air flows delivered through an upper tool 40 as depicted in FIG. 4. Specific ports located within the part 39 provide internal passageways which could contain debris and contamination. These location are defined as areas 88, 89, 90, 91, 92, 93 and 94.

Due to the rotation and discrimination as depicted in FIGS. 11.4-11.6, air flow created by vacuum forces are allow unobstructed access travel through conduit and are connected through tooling 40 and directed through internal ports 48 and 50. Likewise pressurized gasses also allowed unobstructed access travel through conduit and are connected through tooling 40 now travel through internal ports 47 and 49.

The regenerative air flows create an unobstructed and unimpeded delivery of air volumes consistent with effecting the reversed directional cleaning of the internal areas of the part. PWW 88, 89, 92, 93 and 94 experience the vacuum generated forces and air flow in a direction toward ports 48 and 50. PWW 90 and 91 at the same time experience the air pressure forces and air flow in a direction from port 47 and 49.

Referring to FIG. 12.2, the reference Figure depicts the combined air flow generated by the initiation and completion of the second phase of a pulse cycle as depicted in the above referenced FIGS. 11.1-11.6 above. A specific partition of part 39 is depicted in a transverse sectional view as it would be exposed to the forces created by the process and air flows delivered through an upper tool 40 as depicted in FIG. 4. Specific ports located within the part 39 provide internal passageways which could contain debris and contamination. These locations are defined as areas 88, 89, 90, 91, 92, 93 and 94.

Due to the rotation and discrimination as depicted in FIGS. 11.4-11.6, air flow directions are reversed and vacuum forces are allowed unobstructed access travel through conduit and are connected through tooling 40 and directed through internal ports 47 and 49. Likewise pressurized gasses also allowed unobstructed access travel through conduit and are connected through tooling 40 now travel through internal ports 48 and 50.

The regenerative air flows create an unobstructed and unimpeded delivery of air volumes consistent with effecting the reversed directional cleaning of the internal areas of the part. PWW 88, 89, 92, 93 and 94 experience the pressure forces and air flow in a direction from ports 48 and 50. PWW 90 and 91 at the same time experience the vacuum forces and air flow in a direction toward port 47 and 49.

Referring to FIGS. 12.1 and 12.2, the rapid reversing and displacement of the air flows as depicted across a port area 92 act to displace contamination which resides or is located in an area where traditional air flows have little effect. Air flows tend to create eddy currents and when passing contours such as 95 the air velocity is reduced through placing the debris into a pocket area 96. The debris remains in this location as further air flows also act to contain it as greater air flow and lower air pressures across the area 96 will not displace the debris. However, with the process as described the debris is vibrantly agitated and traditional eddy flow currents caused by a directional air stream are reduced by the constant change of direction. Air volumes provided within the process make a complete exchange of the volume of the part and area to be cleaned so as not to return the debris to any area of the part from which it has been removed.

Figure 13:
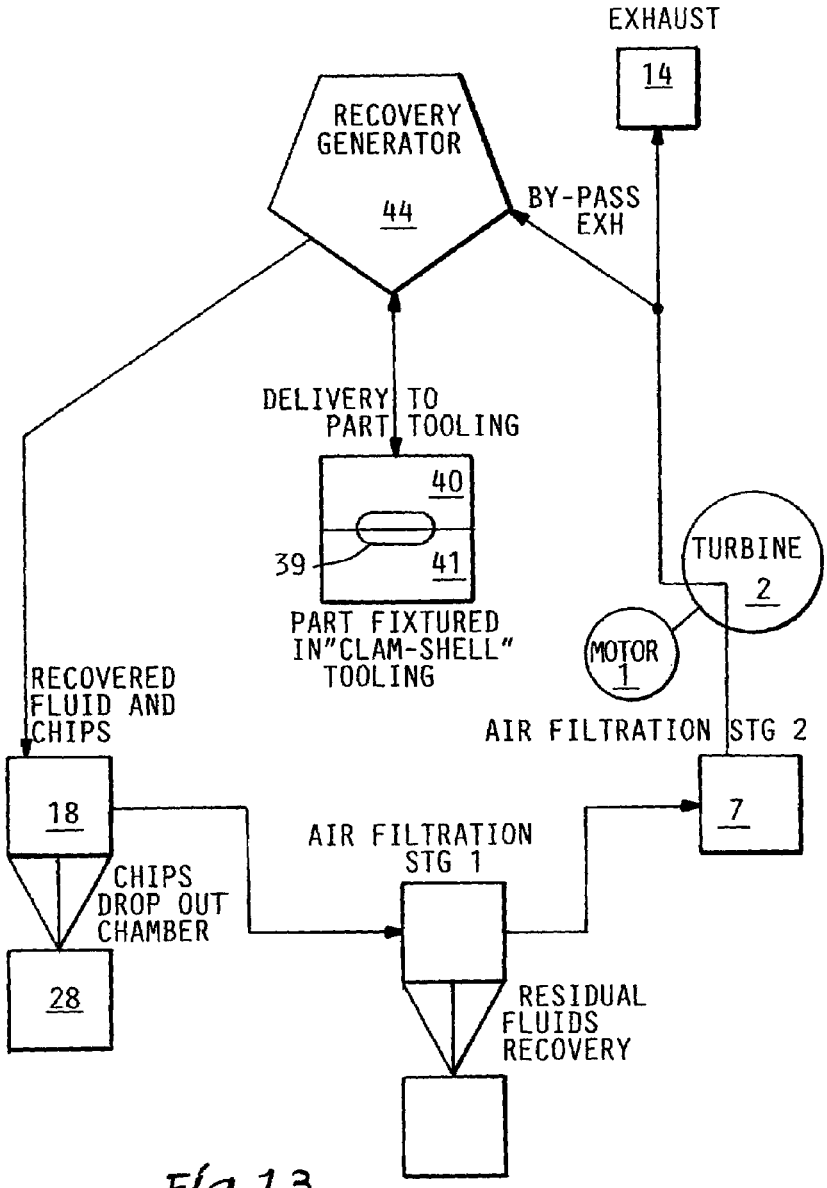
FIG. 13 is a flow chart directing the cleaning process according to one version of the invention.

The flow schematic shown in FIG. 13 represents the flow and recovery of the basic pulsed air, defined as the exhaust and vacuum air source provided within the process. Displacement and use of these air flows can be either through the part, across the surface areas of the part, or alternately within part cavities, holes, or inaccessible areas or finally in a combination of the above.

Figure 14:
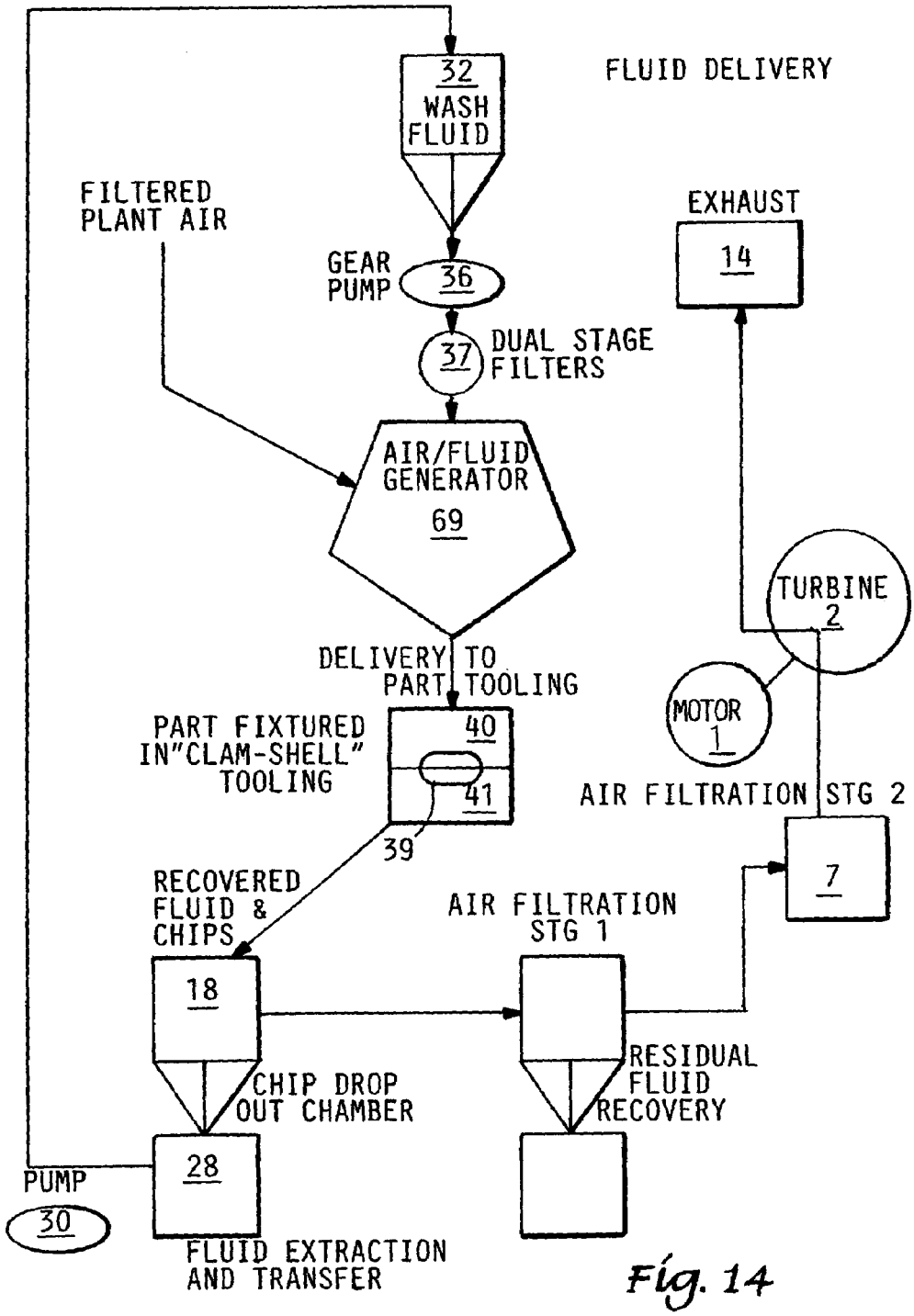
FIG. 14 is a flow chart depicting another form of the process according to the invention.

The flow schematic shown in FIG. 14 represents the flow, recovery, and recirculation of the fluids recovered within the defined process. Displacement and use of the alternating air and fluids can either through the part, across the surface areas of the part, or alternately within part cavities, holes, or inaccessible areas or finally in a combination of the above.

The invention claimed is:

1. A process for cleaning parts comprising:

connecting a vacuum source to a port in a first air pulse generator housing;

connecting a source of pressurized air to another port in said housing;

alternately connecting said vacuum port or said pressurized air port in rapid succession to an outlet port;

connecting an outlet fluid passage to said outlet port to create a rapidly reversing air flow therein; and completely enclosing one or more parts in a tooling cavity; and connecting said tooling cavity to said outlet fluid passage to receive said rapidly reversing, air flow to and form, said tooling cavity whereby rapidly reversing high velocity air flow pulses are directed into said tooling cavity to clean said enclosed one or more parts.

2. A process according to claim 1 wherein said reverse air flow pulses are used to evacuate debris from said tooling cavity removed from said one or more parts.

3. A process according to claim 1 including connecting a source of pressurized liquid cleaning fluid to one port in a second air pulse generator housing and a second port to a source of pressurized air, and alternately connecting each of said ports in said second air pulse generator housing to an outlet port;

connecting said outlet port to a fluid passage and directing outflow therefrom at a part to be cleaned enclosed in said tooling cavity whereby said fluid is expelled under pressure exerted by said pressurized air at said outlet port.

4. A process according to claim 3 wherein said cleaning fluid and pressurized air ports in said second air pulse generator housing are alternately connected to said outlet port by rotating a valve member in said housing.

5. A process according to claim 1 wherein said vacuum port and pressurized air port are alternately connected to said outlet port by rotating a valve member in said first generator housing.

6. A process according to claim 1 further including connecting a plurality of ports to said vacuum and a plurality ports to said source of pressurized air and an outlet associated with sets of vacuum source and air pressure ports to alternately create pulses of vacuum and pressurized air, and connecting each outlet to fluid passage to direct said pulses at a different region of said one or more parts in said tooling cavity.

* * * * *